US007120088B1

(12) United States Patent
Gieseke et al.

(10) Patent No.: US 7,120,088 B1
(45) **Date of Patent: *Oct. 10, 2006**

(54) ARRAY SYSTEM FOR SUPERCAVITATING HYDROFOILS

(75) Inventors: Thomas J. Gieseke, Newport, RI (US); Robert Kuklinski, Portsmouth, RI (US); Abraham N. Varghese, Wakefield, RI (US); John R. Grant, Jamestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 223 days.

This patent is subject to a terminal disclaimer.

(21) Appl. No.: 10/911,751
(22) Filed: Jul. 30, 2004
(51) Int. Cl.
*H04K 3/00* (2006.01)
(52) U.S. Cl. ..... 367/99
(58) Field of Classification Search ..... 367/99; 114/274
See application file for complete search history.

(56) References Cited

U.S. PATENT DOCUMENTS 6,744,694 B1 * 6/2004 Gieseke et al. ..... 367/1

* cited by examiner

*Primary Examiner*—Dan Pihulic
(74) *Attorney, Agent, or Firm*—James M. Kasischke; Jean-Paul A. Nasser; Michael P. Stanley

(57) ABSTRACT

A sonar system includes a forward looking array which is embedded in a cavitator for generating a gaseous cavity which minimizes hydrodynamic noise resulting from turbulent pressure fluctuations. A marine vessel incorporating the sonar system includes a hull, a hydrofoil suspended beneath the hull by a strut, and a cavitator for generating a laminar flow over the hydrofoil and for creating a cavity for eliminating turbulent flow contact. The cavitator is located at a leading edge area of the hydrofoil. The sonar array is embedded into the cavitator.

16 Claims, 1 Drawing Sheet

ARRAY SYSTEM FOR SUPERCAVITATING HYDROFOILS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to a sonar system which utilizes a gaseous cavity to eliminate hydrodynamic noise associated with turbulent boundary layers and turbulent wakes. More specifically the present invention relates to a sonar system that can be utilized on a hydrofoil marine vessel.

(2) Description of the Prior Art

Marine operators would like to operate high-frequency sonar systems from high speed surface craft. These craft can operate at speeds exceeding 30 knots, but they produce bubbly wakes (high frequency noise source), have noisy propulsors, and have noisy appendages. Sonar systems towed in or operating near their wakes are adversely affected by this generation of background noise, thus limiting their effective detection range.

A similar problem exists for very fast transport ships. Some futuristic concepts have been proposed which operate at speeds up to and exceeding 100 knots. The ability of these ships to maneuver at very high speeds is limited. Consequently, the ability to detect obstacles at significant range increases the ability of these craft to avoid collisions with marine mammals, mines, and debris.

Sonar systems towed at very high speeds are affected by several noise sources which may be controllable. The turbulent flow of water over the streamlined fairing of an array generates pressure fluctuations on the fairing. Both turbulent boundary layers and turbulent wakes contribute to this type of structural excitation. The pressure fluctuations can be experienced directly on the array when the flow over the array is turbulent, or indirectly as pressure fluctuations away from the sensor face are transmitted through the structure to the array. Fluctuating cavitation bubbles and collapsing vapor bubbles can also produce large structural excitations. The best way to minimize these types of hydrodynamic noise is to maintain laminar flow over the array face and to physically isolate the array face from portions of the structure experiencing large pressure fluctuations.

The vessel propulsion system produces a large amount of noise. Components of this noise include blade tonals, cavitation bubbles, and entrained air which produce noise that can propagate through the environment to the array. Similarly, breaking bow waves, hull slapping, ship machinery noise, and other ship related noise sources can reach the array through the environment. Isolating the array from these sources by eliminating the direct acoustic path between the source and the array would greatly improve the array performance.

A mechanical path from the noise source through the array supporting structure can create another acoustic problem for the array. However, mechanical isolation techniques are advanced and can minimize these effects.

SUMMARY OF THE INVENTION

Accordingly, it is an object of the present invention to provide a sonar system having a forward looking sonar array which is isolated from own-ship and wake noise.

It is a further object of the present invention to provide a sonar system which minimizes hydrodynamic noise resulting from turbulent pressure fluctuations.

It is still another object of the present invention to provide a sonar system of the present invention in a high speed marine vessel.

The foregoing objects are attained by the sonar system of the present invention.

In accordance with the present invention, a sonar system broadly comprises a forward looking array which is embedded in a cavitator. The cavitator generates a gaseous cavity that minimizes hydrodynamic noise resulting from turbulent pressure fluctuations.

As incorporated with a marine vessel, the present invention broadly comprises a hull, a hydrofoil suspended beneath the hull by a strut, and means for generating a laminar flow over said hydrofoil and for creating a cavity. The laminar flow generating and cavity creating means is located at a leading edge area of the hydrofoil. The sonar array is embedded in the laminar flow generating and cavity creating means.

Other details of the array system for supercavitating hydrofoils of the present invention, as well as other objects and advantages attendant thereto, are set forth in the following detailed description and the accompanying drawings.

DESCRIPTION OF THE PREFERRED EMBODIMENT(S)

A sonar array system for use on marine vessels having supercavitating hydrofoils is provided by the present invention. The sonar array system utilizes a gaseous cavity formed in the wake of a cavitator instrumented with forward looking sonar array elements.

Figure 1:
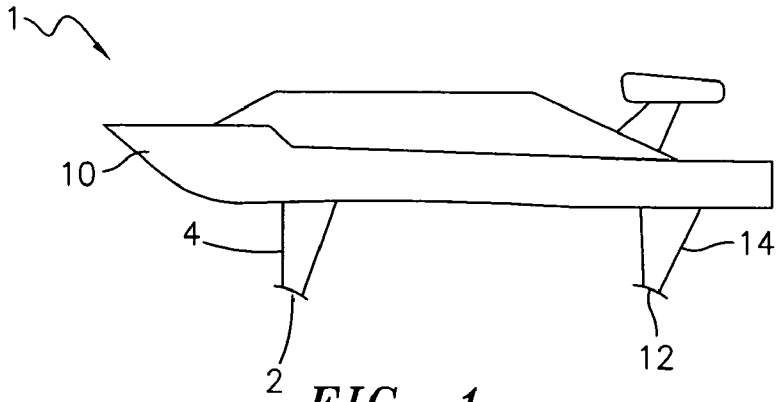
FIG. 1 is a side view of a marine vessel incorporating the sonar system of the present invention.
Figure 2:
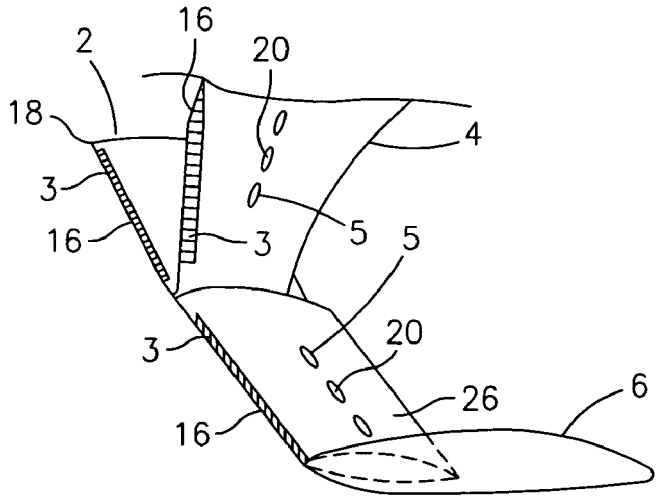
FIG. 2 is a perspective view of a hydrofoil attached to the marine vessel of FIG. 1.

FIGS. 1 and 2 illustrate the basic concept of the present invention. As shown in FIG. 1, a marine vessel 1 has a hull 10 with front and rear hydrofoils 2 and 12 attached to the hull 10 by front and rear struts 4 and 14.

In accordance with the present invention, a cavitator 16 is attached to the leading edge 18 of the front hydrofoil 2 and/or the strut 4. Sonar arrays 3 are also positioned on the leading edge 18 of the front hydrofoil 2 and strut 4. The cavitators 16 cause a cavitation induced vapor bubble 6 to form in the wake of each cavitator 16. Sonar array 3 is positioned to be in liquid portion in front of the vapor bubble 6. Each cavitator 16 may be a simple flat plate arranged normal to the flow of water over the hydrofoil 2. Alternatively, each cavitator 16 may be shaped like a disc, a cone, or a hemisphere, or have a streamlined shape. Each cavitator 16 may be axisymmetric or largely two dimensional. Each cavitator 16 preferably is arranged to maintain a laminar flow over the entire surface of the hydrofoil 2 and/or the surfaces of the strut 4 until the flow separates at the base of the respective hydrofoil and/or strut.

The sonar array 3 may be formed by a plurality of sonar array elements incorporated or embedded into a front surface of the cavitator 16. A communication means (not shown) can transfer received acoustic signals from arrays 3 up through strut 4 to sonar equipment aboard vessel 1. Care must be taken to guarantee that the flow over the array face is laminar. If the flow becomes turbulent prior to separation, significant edge noise may be generated at the separation point of the array. In a preferred embodiment of the present invention, the sonar array elements are forward looking sonar array elements. The sonar array elements are embedded with sufficient density and number to enable forward looking acoustic beams.

Figure 3:
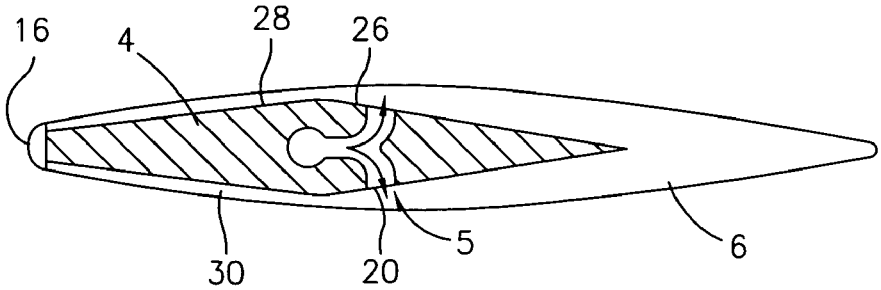
FIG. 3 is a cross section of a strut which supports the hydrofoil of FIG. 2.
Figure 4:
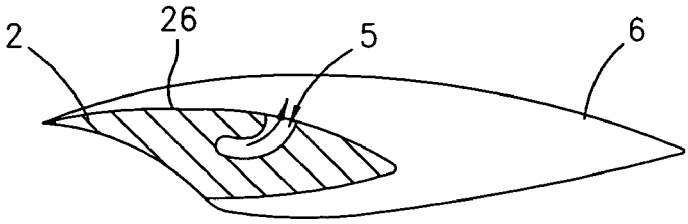
FIG. 4 is a cross section of the hydrofoil of FIG. 2.

In accordance with the present invention, the hydrofoil 2 and the strut 4 are each provided with a ventilation system 5. Each ventilation system 5 has one or more discharge nozzles 20 for discharging a gas or vapor in a quantity sufficient to create a gaseous cavity. For example, as shown in FIG. 4, one or more nozzles 20 may be incorporated into an upper surface 26 of the hydrofoil 2. Further, as shown in FIG. 3, one or more nozzles 20 may be incorporated into each of two opposed strut surfaces 28 and 30. The ventilation system 5 further includes a source of gas or vapor (not shown) and suitable ducting (not shown) for delivering the gas or vapor from the source to each of the nozzles 20. This cavity envelops the supporting structure and all equipment downstream of each cavitator 16. By maintaining laminar flow over each sonar array 3 and eliminating all turbulent boundary layers and attached wakes, the hydrodynamic excitation is eliminated. A baffling effect is also realized by creating a vapor shield between each sonar array 3 and any acoustic sources aft of the array such as a ship propulsor.

The marine vessel 1 is preferably a high speed surface ship. The sonar system operation relies at least in part upon the ship speed to enable generation of the gaseous cavity. A ventilation system can also be used to enhance or form this cavity.

The support strut 4 is preferably a cavitating support strut. As shown in FIG. 3, the strut 4 may be streamlined to minimize drag and noise production. The shielding effects of the gas bubble and mechanical isolation reduce the impact of the strut generated noise. The support strut 4 contains ventilation ducting (not shown) and the signal and communication means (not shown) to each array 3. If desired, the strut 4 may be extendable to increase the stand-off between each array 3 and the hull 10 and to enable complete retraction of the system into the marine vessel 1. Any suitable means known in the art may be used to extend and/or retract the strut 4.

As can be seen from the FIGS. 1–4, to enable the formation of a suitable size cavity 6, gas is pumped through the nozzles 20 in the strut 4 to the area just aft of each cavitator 16. Gas injection increases the size of the gaseous sheet for a given size cavitator. Significant ventilation rates may be required to generate large cavities at modest ship speeds. Preferably, each cavity 6 is inflated to envelop the entire support strut 4 and hydrofoil 2. The gas bubble which is formed aft of each cavitator 16, as a result of the injected air, eliminates contact of turbulent flow with the structure containing the sonar array 3.

With the gaseous sheet created and mechanical isolation incorporated, the direct paths between the ship noise sources and each array 3 are reduced, especially sources aft of the array system. The noise produced by the cavity and each cavitator are minimal because the flow separating from each cavitator is laminar (no fluctuating edge forces) and the cavity closes as large gas bubbles.

The sonar array system of the present invention minimizes the effects of hydrodynamically excited noise and reduces the acoustic and structural path between significant own ship noise sources. This enables very high speed ship operations with low array noise.

If desired, the ship hull 10 can be partially wetted, using the hydrofoil lift to reduce the displaced volume of the vessel. Further, the pressure side of the hydrofoil can be fully instrumented to provide increased array area.

It is apparent that there has been provided in accordance with the present invention an array system for supercavitating hydrofoils which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A sonar array system for minimizing the effects of a hydrodynamically excited noise comprising:

a first element capable of inducing cavitation when moved at a speed through water;

a cavitator attached to a leading edge of said first element; and a plurality of sonar elements forming an array embedded within said cavitator.

2. A sonar array system according to claim 1, wherein said cavitator is sized to prevent turbulent flow from contacting said first element.

3. A sonar array system according to claim 2, wherein said cavitator induces cavitation behind said sonar elements; and said system further comprising a ventilation system incorporated into said first element for increasing the size of a gaseous cavity created by the induced cavitation.

4. A sonar array system according to claim 1, wherein said sonar elements generate forward looking acoustic beams.

5. A marine vessel comprising:

a hull;

a strut joined to said hull;

a hydrofoil suspended beneath said hull by said strut;

means for generating a laminar flow over said hydrofoil and for creating a cavity for eliminating turbulent flow contact located at a leading edge area of said hydrofoil; and a sonar array embedded into said laminar flow generating and cavity creating means.

6. A marine vessel according to claim 5, wherein said laminar flow generating and cavity creating means comprises a cavitator.

7. A marine vessel according to claim 6, wherein said cavitator is formed by a flat plate arranged normal to water flow over said hydrofoil.

8. A marine vessel according to claim 6, wherein said cavitator is a cone-shaped device.

9. A marine vessel according to claim 5, wherein said cavity has sufficient size to preclude said turbulent flow contact with said hydrofoil.

10. A marine vessel according to claim 5, further comprising a means for generating a laminar flow over said strut and for creating a cavity for eliminating turbulent flow contact located at a leading edge area of said strut.

11. A marine vessel according to claim 5, wherein said strut is shaped to reduce drag and noise production.

12. A marine vessel according to claim 5, wherein said strut is extendable to increase the separation between the hull and the sonar array.

13. A marine vessel according to claim 5, further comprising a ventilation system joined to said hydrofoil to increase the size of the cavity generated by said cavity creating means.

14. A marine vessel according to claim 13, wherein said ventilation system includes at least one discharge nozzle for discharging gas over a part of said hydrofoil.

15. A marine vessel according to claim 14, wherein said ventilation system is joined to said strut for discharging gas over a portion of said strut.

16. A marine vessel according to claim 15, wherein said ventilation system at least one discharge nozzle on each of two opposed surfaces of said strut.

* * * * *